US009205894B2

(12) United States Patent
Lee et al.

(10) Patent No.: US 9,205,894 B2
(45) **Date of Patent: *Dec. 8, 2015**

(54) SEALED DERRICK STRUCTURE FOR POLAR VESSELS

(75) Inventors: Yu Young Lee, Gyeongsangnam-do (KR); D. Scott Brittin, Katy, TX (US)

(73) Assignees: Daewoo Shipbuilding & Marine Engineering Co., Ltd., Seoul (KR); Transocean Sedco Forex Ventures Limited, George Town (KY)

( * ) Notice: Subject to any disclaimer, the term of this patent is extended or adjusted under 35 U.S.C. 154(b) by 183 days.

This patent is subject to a terminal disclaimer.

(21) Appl. No.: 13/881,368

(22) PCT Filed: Jun. 22, 2011

(86) PCT No.: PCT/KR2011/004554

§ 371 (c)(1),
(2), (4) Date: Jul. 26, 2013

(87) PCT Pub. No.: WO2012/060527

PCT Pub. Date: May 10, 2012

(65) Prior Publication Data

US 2013/0291780 A1 Nov. 7, 2013

(30) Foreign Application Priority Data

Nov. 4, 2010 (KR) ..... 20-2010-0011352 U

(51) Int. Cl.

| | |
|---|---|
| ***B63B 27/04*** | (2006.01) |
| ***B63H 21/34*** | (2006.01) |
| ***E21B 15/00*** | (2006.01) |

(Continued)

(52) U.S. Cl.

CPC ..... *B63B 27/04* (2013.01); *B63H 21/34* (2013.01); *B63J 2/00* (2013.01); *B63J 2/02* (2013.01); *E21B 15/003* (2013.01); *E21B 15/02* (2013.01); *B63B 35/08* (2013.01); *B63B 35/4413* (2013.01); *B63J 2/10* (2013.01)

(58) Field of Classification Search

CPC .... B63B 27/04; B63B 35/08; B63B 35/4413; B63H 21/34; E21B 15/003; E21B 15/02; B63J 2/00; B63J 2/02; B63J 2/10

USPC ..... 114/211, 268; 454/78; 374/143

See application file for complete search history.

(56) References Cited

U.S. PATENT DOCUMENTS 2,153,350 A 4/1939 Stimac
2,691,272 A * 10/1954 Townsend et al. ..... 175/8

(Continued)

FOREIGN PATENT DOCUMENTS

GB 611961 A * 11/1948
JP 60-62394 A 4/1985

(Continued)

*Primary Examiner* — Anthony Wiest
(74) *Attorney, Agent, or Firm* — Seed IP Law Group PLLC

(57) ABSTRACT

Provided is an enclosed derrick structure of an arctic ship, which provides an installation space for an exhaust unit at an upper portion of an enclosed derrick. The enclosed derrick structure of the arctic ship includes: an enclosed derrick; a crown block section disposed at an upper portion of the enclosed derrick such that a crown block is installed and an installation workspace is formed thereinside; and an exhaust unit installed in the installation workspace to communicate with the exterior.

4 Claims, 1 Drawing Sheet

(51) Int. Cl.

| | |
|---|---|
| ***E21B 15/02*** | (2006.01) |
| ***B63J 2/00*** | (2006.01) |
| ***B63J 2/02*** | (2006.01) |
| *B63B 35/08* | (2006.01) |
| *B63B 35/44* | (2006.01) |
| *B63J 2/10* | (2006.01) |

(56) References Cited

U.S. PATENT DOCUMENTS

| | | | | |
|---|---|---|---|---|
| 2,804,951 | A * | 9/1957 | Kolt | 52/4 |
| 3,850,125 | A | 11/1974 | Anders | |
| 4,613,001 | A | 9/1986 | Edberg et al. | |
| 4,627,767 | A * | 12/1986 | Field et al. | 405/196 |
| 4,666,341 | A | 5/1987 | Field et al. | |
| 4,991,532 | A | 2/1991 | Locke | |
| 5,927,222 | A | 7/1999 | Eakin et al. | |
| 2003/0196791 | A1 | 10/2003 | Dunn et al. | |

FOREIGN PATENT DOCUMENTS

| | | | |
|---|---|---|---|
| JP | 60-126589 | U | 8/1985 |
| JP | 63-6998 | U | 1/1988 |
| JP | 2-100994 | U | 8/1990 |
| JP | 3002545 | B2 | 1/2000 |
| JP | 2000238695 | A | 9/2000 |
| JP | 2005-306315 | A | 11/2005 |
| KR | 20-0226940 | Y1 | 6/2001 |
| KR | 10-2004-0020440 | A | 3/2004 |
| KR | 20-0431766 | Y1 | 11/2006 |
| KR | 10-2009-0053184 | A | 5/2009 |
| KR | 10-2010-0028480 | A | 3/2010 |
| WO | 97/42393 | A1 | 11/1997 |

* cited by examiner

SEALED DERRICK STRUCTURE FOR POLAR VESSELS

CROSS-REFERENCE(S) TO RELATED APPLICATION

This application is a national stage application filed under 35 U.S.C. §371 of International Application No. PCT/KR2011/004554, accorded an International Filing Date of Jun. 22, 2011, which claims priority of Korean Utility Model Registration No. 20-2010-0011352, filed on Nov. 4, 2010, in the Korean Intellectual Property Office, which is hereby incorporated by reference in its entirety.

BACKGROUND

1. Technical Field

The present disclosure relates to an enclosed derrick structure of an arctic ship, and more particularly, to an enclosed derrick structure of an arctic ship, which provides an installation space for an exhaust unit at an upper portion of an enclosed derrick.

2. Description of the Related Art

Due to the rapid international industrialization and industrial development, the use of the earth's resources, such as oil, is gradually increasing. Accordingly, stable production and supply of oil is emerging as a very important worldwide issue.

For this reason, much attention has recently been paid to development of small marginal fields or deep-sea oil fields, which have been ignored because of their low economic feasibility. Therefore, with the development of offshore drilling techniques, drill ships equipped with drilling equipment suitable for development of such oil fields have been developed.

In conventional offshore drilling, rig ships or fixed type platforms have been mainly used, which can be moved only by tugboats and are anchored at a position on the sea using a mooring gear to conduct an oil drilling operation. In recent years, however, so-called drill ships have been developed and used for offshore drilling. The drill ships are provided with advanced drilling equipment and have structures similar to typical ships such that they can make a voyage using their own power. Since drill ships have to frequently move in order for development of small marginal fields, they are constructed to make a voyage using their own power, without assistance of tugboats.

Meanwhile, a moonpool is formed at the center of a rig ship, a fixed type platform or a drill ship, such that a riser or a drill pipe is vertically movable through the moonpool. In addition, a derrick in which a variety of drilling equipment are integrated is installed on a deck.

BRIEF SUMMARY

An aspect of the present invention is directed to an enclosed derrick structure of an arctic ship, in which an upper portion of an enclosed derrick is gradually widened upwardly, thereby facilitating equipment installation and maintenance of a crown block platform.

Meanwhile, in order for drilling of natural resources in extremely cold regions such as arctic regions, arctic rig ships, fixed type arctic platforms, and arctic ships such as arctic drill ships have been built. Such arctic ships may be constructed to have an enclosed area in almost all zones in order to prevent freezing in extremely low temperature environments and ensure the smooth operation of equipment and crews' safety.

In particular, a derrick and a moonpool of an arctic ship are enclosed in order to protect internal equipment and workers. A ventilating system may be installed in the enclosed derrick and the enclosed moonpool in order for protection and ventilation of the inner spaces thereof. In particular, in order to meet a rule and regulation in an extremely low temperature region, it is preferable that the ventilating system supplies heated air to the derrick and the moonpool, and exhausts cooled air to the exterior through an upper portion of the derrick. In this case, a crown block section is formed at the upper portion of the derrick, and a crown block is installed inside the crown block section. The crown block section may be formed in a conical shape which becomes narrower upwardly. A plurality of exhaust fans may be installed inside the crown block section.

However, due to the structural shape of the conical crown block section that becomes narrower upwardly, such an enclosed derrick is weak to accessibility. Thus, it is difficult to install and maintain the exhaust fan, and the inner spaces of the enclosed derrick and the enclosed moonpool may not be effectively protected. Moreover, smooth ventilation may not be maintained.

According to an embodiment of the present invention, an enclosed derrick structure of an arctic ship includes: an enclosed derrick; a crown block section disposed at an upper portion of the enclosed derrick such that a crown block is installed and an installation workspace is formed thereinside; and an exhaust unit installed in the installation workspace to communicate with the exterior.

The width of the crown block section may be gradually widened upwardly, and the width of the installation workspace may be gradually widened upwardly.

A pair of inclined planes may be symmetrically formed on both sides of the crown block, such that a lower perimeter of the crown block is formed to be narrower than an upper perimeter thereof.

A pair of inclined planes may be symmetrically formed on both sides of the crown block section, such that a lower perimeter of the crown block section is formed to be wider than an upper perimeter thereof.

A crown block platform for installation of the crown block may be formed on the bottom of the crown block section.

The exhaust unit may include: an exhaust port provided in a side of the crown block to communicate with the exterior; an exhaust fan coupled to an inner side of the exhaust port; and a first open/close valve installed at a downstream side of the exhaust fan to selectively allow the exhaust of inside air.

The enclosed derrick structure may further include: a drill floor on which the enclosed derrick is disposed; an enclosed moonpool coupled to communicate with a lower portion of the enclosed derrick; and a supply unit disposed at the outside of the drill floor to supply outside air to the enclosed moonpool.

The supply unit may include: an inlet port into which the outside air flows; a heater installed adjacent to the inlet port; a supply fan coupled to the inlet port to supply the outside air; and a second open/close valve installed at a downstream side of the supply fan to selectively allow the inflow of the outside air.

The enclosed derrick structure may further include a supply pipe coupled from the second open/close valve to the enclosed moonpool, such that the outside air from the supply fan is supplied to the enclosed moonpool.

According to another embodiment of the present invention, an enclosed derrick structure of an arctic ship is characterized in that an exhaust unit is installed at an upper inner side of an enclosed derrick.

An installation workspace whose width is gradually widened upwardly may be formed at an upper portion of the enclosed derrick, and a crown block may be installed in the installation workspace. A crown block platform for installation and maintenance of the exhaust unit may be disposed at an upper portion of the enclosed derrick.

DETAILED DESCRIPTION

Exemplary embodiments of the present invention will be described below in detail with reference to the accompanying drawings.

Figure 1:
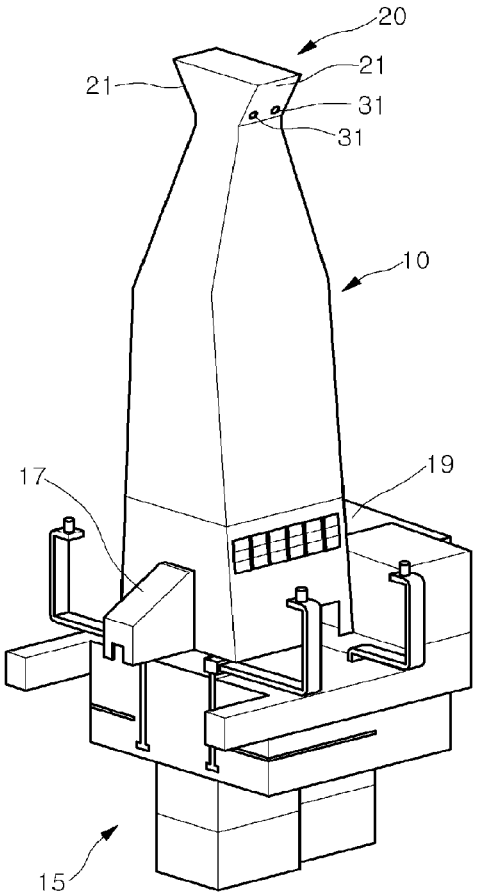
FIG. 1 is a perspective view illustrating an enclosed derrick structure of an arctic ship according to an embodiment of the present invention.
Figure 2:
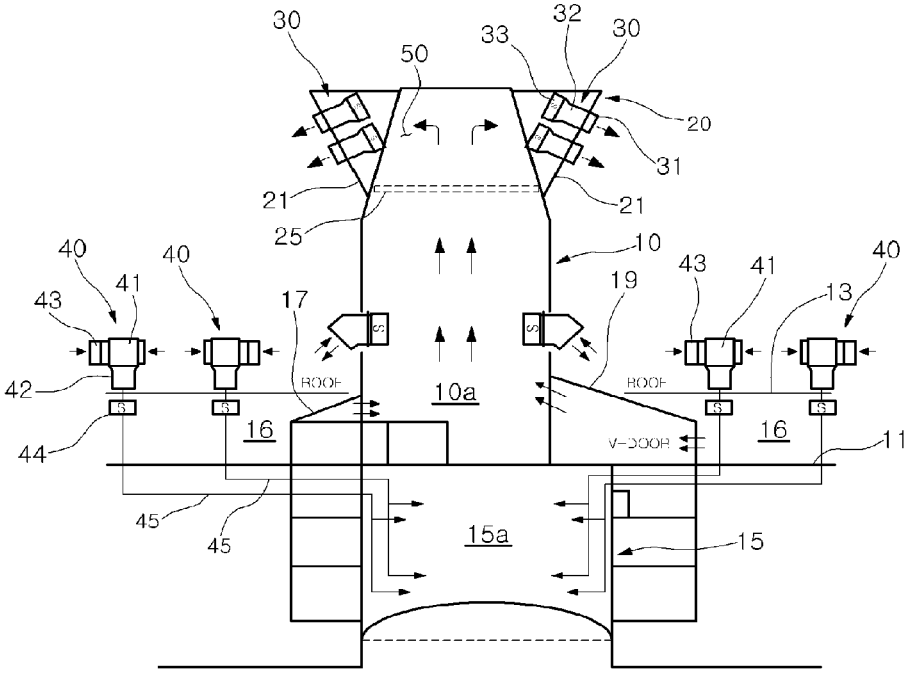
FIG. 2 is a cross-sectional view illustrating the enclosed derrick structure of the arctic ship and a ventilating system installed therein according to an embodiment of the present invention.

FIGS. 1 and 2 illustrate an enclosed derrick structure of an arctic ship according to an embodiment of the present invention.

As illustrated in FIGS. 1 and 2, the enclosed derrick structure according to the embodiment of the present invention includes an enclosed derrick 10 installed in an arctic ship, and an enclosed moonpool 15 coupled to a lower portion of the enclosed derrick 10.

The enclosed derrick 10 and the enclosed moonpool 15 are coupled such that inner spaces 10*a* and 15*a* thereof communicate with each other. The enclosed derrick 10 is disposed on a drill floor 11 of the ship, and the enclosed moonpool 15 is disposed under the drill floor 11.

An outer wall of the enclosed derrick 10 is formed in an enclosed structure. The outer wall of the enclosed derrick 10 may be made of a fiberglass reinforced polymer (FRP), a stainless steel sheet (SUS sheet), a zinc alloy structure, or a sandwich panel. Enclosed tunnels 17 and 19 are provided at sides of the enclosed derrick 10. Openings are formed at the ends of the enclosed tunnels 17 and 19, such that equipment such as a riser can be passed therethrough. The enclosed tunnels 17 and 19 are adjacent to riser tensioner rooms 16.

Supply units 40 are installed outside the enclosed derrick 10 to supply outside air from the outside of the enclosed derrick 10 to an inner space 15*a* of the enclosed moonpool 15 or an inner space 10*a* of the enclosed derrick 10.

According to an embodiment, the supply unit 40 includes one or more inlet ports 41 installed at the outside of the drill floor 11, one or more supply fans 42 coupled to the inlet ports 41, one or more heaters 43 installed adjacent to the inlet ports 41, and one or more open/close valves 44 installed at a downstream side of the supply fans 42 to selectively allow the inflow of the outside air.

The inlet port 41 is installed at a roof 13 side of the riser tensioner room 16, and the outside air is introduced through the inlet port 41.

The supply fan 42 is coupled to a lower portion of the inlet port 41 and configured to forcibly blow the outside air to the inner space 15*a* of the enclosed moonpool 15. The outside air forcibly blown by the supply fan 42 may be supplied through a supply pipe 45 to the inner space 15*a* of the enclosed moonpool 15 or a lower portion of the inner space 10*a* of the enclosed derrick 10.

When a temperature is low in an extremely cold region (in particular, below 0° C., like a winter season), the heater 43 heats the outside air introduced through the inlet port 41. The heated air is supplied to the inner spaces 15*a* and 10*a* of the moonpool 15 and the derrick 10 by the supply fan 42. Accordingly, internal equipment, workers, and working conditions can be safely protected and maintained from external extreme environments.

The open/close valve 44 may be selectively opened or closed to block an air flow in the event of a fire or other emergency or in the repair of the supply fan 42.

Meanwhile, an exhaust unit 30 is installed at an upper portion of the enclosed derrick 10. When the outside air is supplied to the inner space 15*a* of the moonpool 15 by the supply unit 40, the exhaust unit 30 guides the outside air to flow upwardly from the inner space 15*a* of the enclosed moonpool 15 to the upper portion of the inner space 10*a* of the enclosed derrick 10.

The upper portion of the enclosed derrick 10 forms a crown block section 20. A crown block (not shown) is installed inside the crown block section 20. The width of the crown block section 20 is gradually widened upwardly, and thus, an installation workspace 50 is formed inside the crown block section 20. In particular, an inclined plane 21 is provided in at least one side of the crown block section 20, and the exhaust unit 30 is installed on the inclined plane 21. In addition, according to the embodiment of FIGS. 1 and 2, it is preferable that a pair of inclined planes 21 is symmetrically formed on both sides of the crown block section 20, and the exhaust units 30 are installed on the respective inclined planes 21.

The lower portion of the installation workspace 50 communicates with the inner space 10*a* of the derrick 10. A crown block platform 25 is installed to cross the lower portion of the installation workspace 50. The crown block (not shown) is installed on the crown block platform 25.

As the crown block section 20 whose upper width becomes gradually wider is installed at the upper portion of the enclosed derrick 10, the installation workspace 50 formed inside the crown block section 20 is gradually widened upwardly. Accordingly, the installation workspace 50 provides a space enough to install the exhaust unit 30 on the side of the crown block section 20 by using the crown block platform 25, installed in the installation workspace 50, and to allow a worker to perform a maintenance task on the exhaust unit 30. Hence, the worker can perform the maintenance task effectively and safely.

By installing the exhaust unit 30 at the upper portion of the enclosed derrick 10, an effective air flow is achieved within the enclosed derrick 10 and the enclosed moonpool 15. Therefore, internal equipment, workers, and working conditions can be protected and maintained safely and effectively.

The exhaust unit 30 includes one or more exhaust ports 31 installed in the inclined plane 21, and one or more exhaust fans 32 coupled to the exhaust ports 31. The exhaust fan 32 is installed within the crown block section 20 and is coupled to a open/close valve 33. The open/close valve 33 may be selectively opened or closed to block an air flow in the event of a fire or other emergency or in the repair of the exhaust fan 32.

As described above, since the crown block section 20 whose upper width becomes gradually wider is installed at the upper portion of the enclosed derrick 10, the crown block platform 25 can be utilized without additional installation of ducts, and a workspace enough to install the exhaust unit 30 can be provided. Therefore, the worker can easily install the exhaust unit 30 at the upper portion of the enclosed derrick 10 and can more effectively perform the maintenance task on the exhaust unit 30. Moreover, the worker's safety can be improved.

According to the embodiments of the present invention, since outside air is supplied to the enclosed moonpool 15 and is exhausted through the upper portion of the enclosed derrick 10, the air flow from the enclosed moonpool 15 to the upper portion of the enclosed derrick 10 is effectively achieved. Therefore, internal equipment, workers, and working conditions within the enclosed derrick 10 can be safely protected and maintained from external extreme environments.

According to the embodiments of the present invention, since the crown block section 20 whose upper width becomes gradually wider is installed at the upper portion of the enclosed derrick 10, the exhaust unit 30 can be installed at the upper portion of the enclosed derrick 10 by utilizing the crown block platform 25. Therefore, the installation costs for additional ducts can be saved, and the worker's safety can be improved.

In addition, the space for the installation of the exhaust fan 32 and the workspace for the maintenance of the exhaust fan 32 can be provided at the upper portion of the enclosed derrick 10.

While the embodiments of the present invention have been described with reference to the specific embodiments, it will be apparent to those skilled in the art that various changes and modifications may be made without departing from the spirit and scope of the invention as defined in the following claims. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A drill ship, comprising:

an enclosed derrick;

a crown block section disposed at an upper portion of the enclosed derrick such that a crown block is installed and an installation workspace is formed thereinside;

an exhaust unit installed in the installation workspace to communicate with a region exterior to the enclosed derricks;

a drill floor on which the enclosed derrick is disposed;

an enclosed moonpool coupled to communicate with a lower portion of the enclosed derrick; and a supply unit disposed to supply outside air to the enclosed moonpool, wherein a width of the crown block section is gradually widened upwardly, and a width of the installation workspace is gradually widened upwardly, wherein the exhaust unit comprises:

an exhaust port provided in a side of the crown block to communicate with the region exterior to the enclosed derrick;

an exhaust fan coupled to an inner side of the exhaust port; and a first open/close valve installed at a downstream side of the exhaust fan to selectively allow the exhaust of inside air, and wherein the supply unit comprises:

an inlet port into which the outside air flows;

a heater installed adjacent to the inlet port;

a supply fan coupled to the inlet port to supply the outside air;

a second open/close valve installed at a downstream side of the supply fan to selectively allow the inflow of the outside air; and a supply pipe coupled from the second open/close valve to the enclosed moonpool, such that the outside air from the supply fan is supplied to the enclosed moonpool.

2. The drill ship according to claim 1, wherein the crown block section has one or more inclined planes on one or more sides thereof.

3. The drill ship according to claim 1, wherein a pair of inclined planes are symmetrically formed on both sides of the crown block section, such that an upper perimeter of the crown block section is formed to be wider than a lower perimeter thereof.

4. The drill ship according to claim 1, wherein a crown block platform for installation of the crown block is formed at a bottom of the crown block section.

* * * * *

UNITED STATES PATENT AND TRADEMARK OFFICE

CERTIFICATE OF CORRECTION

PATENT NO. : 9,205,894 B2
APPLICATION NO. : 13/881368
DATED : December 8, 2015
INVENTOR(S) : Yu Young Lee et al.

It is certified that error appears in the above-identified patent and that said Letters Patent is hereby corrected as shown below:

In the claims,

Column 6, Lines 2-3:
"communicate with a region exterior to the enclosed derricks;" should read, --communicate with a region exterior to the enclosed derrick;--.

Signed and Sealed this
Second Day of August, 2016

Michelle K. Lee

Michelle K. Lee
*Director of the United States Patent and Trademark Office*